US005357760A

United States Patent [19]

Higham

[11] Patent Number: 5,357,760

[45] Date of Patent: Oct. 25, 1994

[54] HYBRID CRYOGENIC VACUUM PUMP APPARATUS AND METHOD OF OPERATION

[75] Inventor: Graham J. Higham, Danville, Calif.

[73] Assignee: Ebara Technologies Inc., Santa Clara, Calif.

[21] Appl. No.: 95,956

[22] Filed: Jul. 22, 1993

[51] Int. Cl.[5] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 3,137,551 | 6/1964 | Mark | 62/55.5 |
| 3,262,279 | 7/1966 | Moore, Jr. | 62/55.5 |
| 3,536,418 | 10/1970 | Breaux | 62/55.5 |
| 3,721,101 | 3/1973 | Sheppard et al. | 62/55.5 |
| 4,718,240 | 1/1988 | Andeen et al. | 62/55.5 |
| 4,757,689 | 7/1988 | Bachler et al. | 62/55.5 |
| 4,873,833 | 10/1989 | Pfeiffer et al. | 62/55.5 |
| 4,910,965 | 3/1990 | Lepofsky et al. | 62/55.5 |
| 5,231,839 | 8/1993 | de Rijke et al. | 62/55.5 |

*Primary Examiner*—Ronald C. Capossela
*Attorney, Agent, or Firm*—Stanley Z. Cole

[57] ABSTRACT

Apparatus for vacuum pumping an enclosed chamber without the use of activated charcoal to remove hydrogen by cryosorption. As a result, the potential for contamination by a sorbent material is eliminated. The pumping structure includes an integral two-stage vacuum pump. The first-stage pump is a cryogenic pump having a pump chamber and cryoarrays mounted on an expander for cryocondensation of the principal gases present in the vacuum chamber. The second-stage pump operates at room temperatures and includes one or more getter pumps whose principal function is to remove hydrogen molecules that may be present in the vacuum chamber after the first-stage cryopump has removed most of the cryocondensable gases from the vacuum chamber. In one aspect of the invention, the first-stage pump is separated from the second-stage pump by a gate valve to protect the getter pumps during the regeneration flushing of nitrogen through the first-stage cryogenic pump chamber. In another aspect of the invention, a technique is disclosed to eliminate the need for a gate valve separating the two pumps. In another aspect of the invention, an ion pump is added to the two-stage vacuum pump to reduce the helium and neon molecules that may be present after the pumping of hydrogen and the other cryocondensable gases in the vacuum chamber.

17 Claims, 3 Drawing Sheets

HYBRID CRYOGENIC VACUUM PUMP APPARATUS AND METHOD OF OPERATION

BACKGROUND OF THE INVENTION

The present invention relates generally to vacuum technology, and more particularly to novel methods and apparatus for cryogenic and other types of high vacuum pumping of unwanted gas molecules, including hydrogen, from an enclosed chamber.

Cryogenic vacuum pumps (also referred to as cryopumps) are widely used in high vacuum applications ($10^{-6}$ to $10^{-11}$ Tort range), e,g., in semiconductor manufacturing Cryopumps are based on the principle of removing neutral gas molecules from a vacuum chamber by having the gas molecules lose enough of their incident kinetic energy by striking a cold surface so that the molecules remain bound to that surface by the dispersion forces of the cryogenic surface. Cryocondensation, cryosorption and cryotrapping are the basic mechanisms that can be involved in the operation of a cryopump. In cryocondensation gas molecules condense over previously condensed gas molecules thus forming a solid condensate. Thick layers of condensate form in pumping large quantities of gas necessitating the removal of the solid condensate during what is termed a regeneration or activation period. Basically regeneration is a process that releases and expels captured gases by warming and flushing the pump with dry and sometimes warmed inert gas.

Gases that are difficult to condense at normal cryopump operating temperatures can be pumped at higher temperatures by cryosorption. In this case, a sorbent material such as activated charcoal is bonded to the cryogenic surface. At cryogenic temperatures the binding energy between the gas molecules and the adsorbing particles is greater than the binding energy between the gas molecules themselves. This causes the gas molecules that cannot be condensed to adhere to the sorbent material and thus be removed from the vacuum system. When several monolayers of adsorbed gas have been built up, the effect of the adsorbing surface is lost and gas can no longer be pumped by this process until the absorbed gas molecules are removed. To remove the gas and reactivate the adsorbing surface, the sorbent material is heated to the point that the adsorbing particles lose their affinity for gas molecules. This releases the gas enabling it to be flushed from the pump chamber.

Cryotrapping can also be used to pump gases that are difficult to condense. In this case, the sorbent material that performs the cryotrapping is an easily condensable gas. The sorbent gas is admired into the pump, forming a condensate on the cold surfaces, The gases that are difficult to condense are also admitted to the pump at the same time as the sorbent gas and adsorbed on the newly formed surface of the easily condensable gas. A mixed condensate is thus formed. For example, if argon and hydrogen are present in a cryopump chamber, for every 1000 molecules of argon that condense, it is possible to trap one molecule of hydrogen in the argon.

Cryopumps are widely used for applications where contamination by non process gases such as hydrocarbons must be avoided. Cryopumps typically use a closed-loop refrigeration system with high-purity helium as the working medium. The refrigeration cycle involves the compression of gaseous helium by a compressor, removal of the heat of compression via a heat exchanger, filtering of the compressed helium, and subsequent two-stage expansion of the gas in a cryoexpander to produce the desired refrigeration. In one type of cryopump, metallic panels are mounted in an array on the first-stage expander within the pump. This cryoarray as it is called, when lowered to $\approx$50° K. to 80° K. by the refrigeration system, pumps water vapor molecules present within the pumping chamber and also functions as a radiation shield to the second stage array. A second stage cryoarray is usually mounted under the first stage and achieves a nominal temperature of 14° K. to pump most other gas molecules. However, the lowest temperature achievable in a refrigerator cooled cryopump is only about 10° K. so that not all gases normally present in a vacuum system can be pumped by cryocondensation. The gases which are difficult to condense in a vacuum system, such as hydrogen, helium and neon, must be pumped by other means, such as cryosorption. One commonly used technique to eliminate such gases uses a sorbent material, such as activated charcoal, permanently attached to the second stage cryoarray. Only relatively low amounts of gas can be pumped by cryosorption, as only a thin layer (up to about 5 monolayers) can be formed on the surfaces before the process ceases. To pump large amounts of gas, a large amount of sorbent material must be used in the pump. The underside of the cryoarray is usually coated with the sorbent material to cryoabsorb the non condensable gases. When the sorbent material becomes saturated, the system must be reactivated.

Unfortunately small particles of the activated charcoal can break off the surface of the cryoarray, migrate through the cryopump to the vacuum chamber and onto the surfaces of the work piece being processed thereby causing contamination. This problem is particularly acute in the manufacture of semiconductors where particles of almost any size are likely to produce defects in the end product. The use of ion pumps in conjunction with cryopumps to enhance cryopump performance is disclosed by Johann de Rijke in "*Performance of a Cryopump-Ion Pump System,*" Journal of Vacuum Science and Technology, Vol. 15, No. 2, March/April 1978, Pp. 756–767. A standard cryopump with sorbent charcoal on the second stage and a standard noble gas ion pump were used to increase total pumping speed and total capacity of gas that can be pumped before regeneration was needed. The disclosed configuration did not address the problem of vacuum system contamination by charcoal particles.

A turbomolecular vacuum pump having a heat exchanger located in its suction port is disclosed in U.S. Pat. No. 4,926,648 issued May 22, 1990 to Okumura et al. The heat exchanger is connected to a refrigerator through a refrigerant pipe. The refrigerant is cooled from about −100° C. to about −190° C. and is used to condense water vapor.

Getter pumps are a very specialized type of noncryogenic pump. Such a pump functions through the chemical sorption of reactive gases that contact the surface of the getter material, such as an alloy of zirconium-vanadium-iron. The sorption of gas molecules by the getter material will continue until the surface layers become saturated, at which point the material must be reactivated by raising under a vacuum, the temperature of the getter material to several hundred ° C. As is well known heating causes the sorbed gas molecules to diffuse into the bulk of the getter material or, as is the case with $H_2$, be driven off as a gas. Many active gases when sorbed into a getter act as "poisons" in the sense that they are irreversibly combined with the getter material thus limiting the useful life of the pump. Getter pumps are typically used for ultra-high vacuum pumping where a vacuum is needed for long periods of times, e.g,, in high energy particle accelerators or in the purification of low pressure rare gases. In applications where the vacuum chamber pressures vary considerably or where work cycles are encountered with new gases being periodically introduced, such as in the manufacture of semiconductors, getter pumps quickly lose their capacity to efficiently pump chemically active gases normally present. After about 40 work cycles the getter material becomes substantially degraded through irreversible sorption of the gases requiring replacement of the entire getter material, For this reason getter pumps have been restricted to special applications where they will not be exposed to large active gases that are irreversibly sorbed by the getter.

In a cryopump structure disclosed in U.S. Pat. No. 5,231,839, "*Methods and Apparatus for Cryogenic Vacuum Pumping with Reduced Contamination*" filed Nov. 27, 1991 by F. Engle and J. de Rijke, the charcoal sorbent material is eliminated to remove the potential contamination caused by charcoal flaking, In place of the charcoal an auxiliary pumping device, such as an ion pump, is employed to remove the difficult to condense gases, such as helium and neon. Cryocondensed argon assists in cryotrapping hydrogen molecules from the main vacuum chamber, A gate valve connecting the ion pump and the main cryogenic pump is closed during periods of high gas loading to prevent overloading of the ion pump. Although such a cryopump system is effective in removing helium and neon without the potential contaminate of charcoal, the system is primarily effective in removing hydrogen gas in applications where a large amount of condensible gas is also pumped, such as argon employed in sputtering applications. Unfortunately hydrogen also is a major contaminant in most semiconductor manufacturing processes.

It is a general object of the present invention to provide an improved structure for vacuum pumping an enclosed chamber and provide consistent vacuum pressures suitable for use in the manufacture of semiconductors.

It is another object of the present invention to provide a cleaner vacuum pumping environment wherein a potential contaminate of the vacuum chamber by a sorbent charcoal material is eliminated.

It is a further object of the present invention to provide an improved pumping apparatus and method for pumping an enclosed chamber containing among other gases, hydrogen.

It is a further object of the present invention to provide an improved pumping structure for pumping an enclosed chamber on a continuous basis independent of the application or vapor loading.

SUMMARY OF THE INVENTION

In accordance with the teachings of the present invention, these and other objectives are achieved through a novel apparatus for pumping an enclosed chamber without the use of activated charcoal as a sorbent material to remove hydrogen. A pumping structure in accordance with one aspect of the invention includes an integral two-stage vacuum pump. The first-stage pump is a cryogenic pump having a pump chamber and mounted on an expander for cryocondensation of the principal gases present in the vacuum chamber. The second-stage pump operates at room temperatures and includes one or more getter pumps whose principal function is to remove hydrogen molecules that may be present in the vacuum chamber after the first-stage cryopump has removed most of the cryocondensable gases from the vacuum chamber. In the preferred embodiment, the first-stage pump is separated from the second-stage pump by a gate valve to protect the getter pumps during regeneration of the cryopump section.

In another aspect of this invention, in those cases where potential damage to getters is not of concern, the gate valve may be removed from the two-stage pump since it is not essential that the second-stage pump be physically separated from the first-stage pump during the regeneration period. Instead of physically isolating the second-stage (getter) pump and flushing nitrogen through the first-stage cryogenic pump during regeneration, dry argon gas is injected into the second-stage pump and exhausted out an exit port on the first-stage cryogenic pump. This effectively removes the unwanted cryocondensed gases in the first-stage cryogenic pump while protecting the getter material from these same gases during their removal. Dry argon, being an inert nonsorbable gas, provides some degree of protection for material from contamination during the regeneration period.

In a third aspect of this invention, in the two-stage vacuum pump including a cryopump and a getter pump, a very small amount of activated charcoal is bonded to one of the cryoarrays in a location designed to remove small quantities of helium and neon that may still be present after the other gases are pumped. To retard the activated charcoal from sorbing the hydrogen and other sorbable gases during cryopumping, the charcoal is kept at an elevated cryogenic temperature. This can be done by reducing the cooling effect of the refrigerator or by heating the area of the charcoal with a predetermined length of resistance wire. Once the vapor pressure drops to relatively low levels indicating that most of the gases have been removed, except for small quantities of helium and neon, the activated charcoal is lowered to appropriate temperatures to allow it to remove the remaining minute quantities of gas including helium and neon.

In a fourth aspect of this invention, in the two-stage vacuum pump including a cryopump and a getter pump, an ion pump is added to supplement the operation of the getter pumps to facilitate the removal of the minute quantifies of helium and neon that may still be present in the pump or the vacuum chamber after the other gases are pumped. The advantage of this hybrid pumping arrangement is that the pumping is accomplished without the need for activated charcoal that could potentially contaminate the vacuum chamber.

BRIEF DESCRIPTION OF THE DRAWINGS

A better understanding of the invention may be had from a consideration of the following detailed description, taken in conjunction with the accompanying drawings in which.

DETAILED DESCRIPTION

Figure 1:
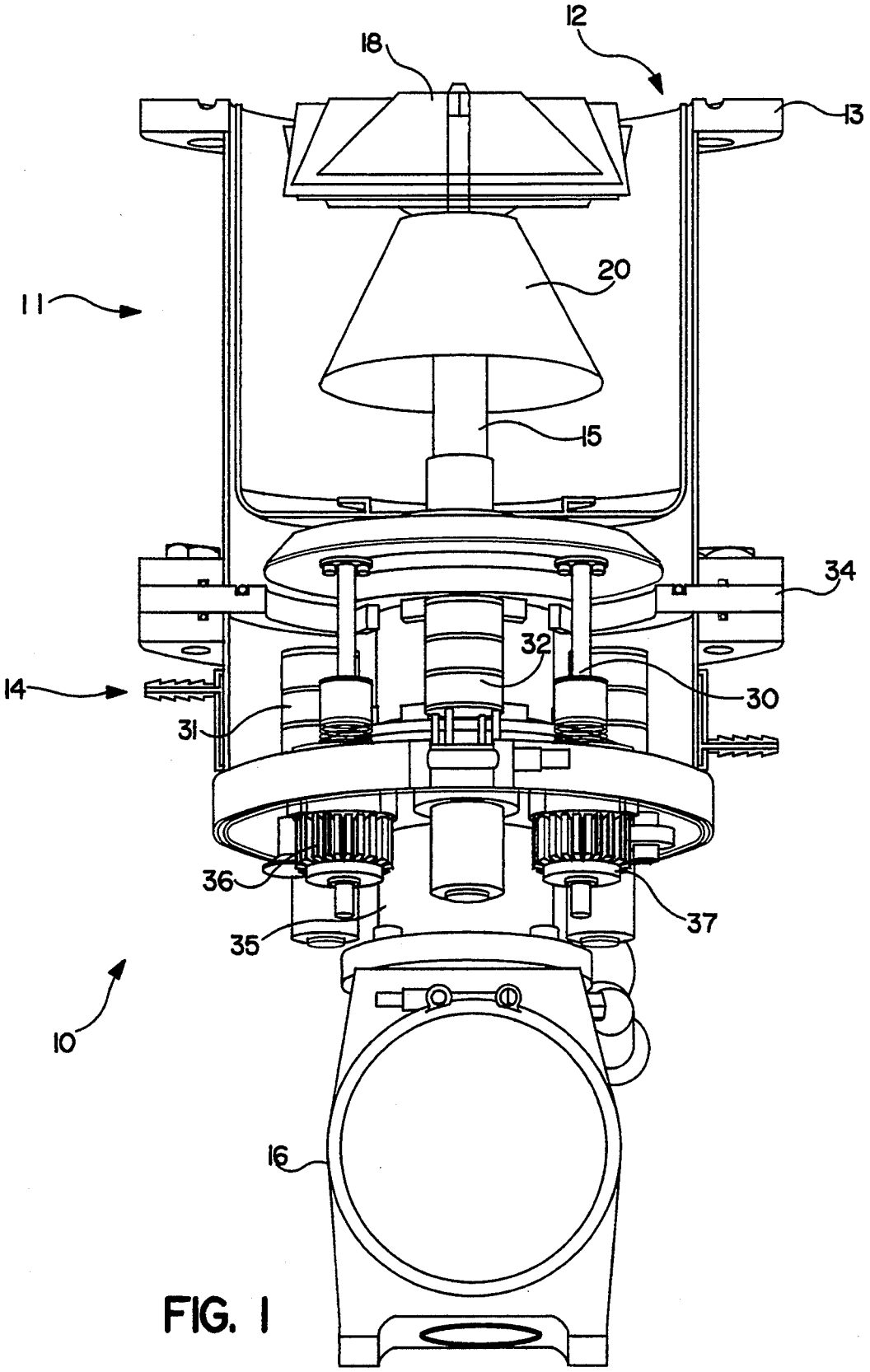
FIG. 1 is a perspective cross-sectional diagram representation of a hybrid vacuum pump in accordance with the invention.

Referring now to FIG. 1, a cryopump structure 10 in accordance with one aspect of the invention includes a first-stage cryogenic pump 11 and a second-stage getter pump 14 separated from the first-stage pump 11 by a gate valve 34. Mechanically, cryopump 10 has a flange 13 adapted for physical connection and vacuum sealing to a vacuum chamber through a high vacuum valve not shown in FIG. 1. Inlet 12 allows gas molecules within the vacuum chamber to flow into cryopump 10 for removal by either the cryopump (section 11) or the getter pump (section 14). The cryopump 10 includes a refrigerator 16 in thermal contact with first and second cryoarrays, 18 and 20 respectively, mounted on an expander 15 for cryocondensation of the principal gases entering the cryopump. Although the second-stage cryoarray 20 is shown in FIG. 1 as a conical section, other surfaces could be utilized to advantage. The basic construction of cryopumps is well known in the art. The first-stage cryopump 11 is very similar in construction to a standard commercially available cryopump, such as Model FS-8LP, manufactured and sold by Ebara Technologies Incorporated, Santa Clara, Calif. The principal difference between the structure of FIG. I and prior art pumps is that in most commercially available cryopumps, including the one mentioned, the second-stage cryoarray 20 consists of a multiple vein structure which is needed to provide the surface area to support the activated charcoal for pumping reasonable quantities of hydrogen normally present in a vacuum chamber. In the preferred embodiment, however, the second-stage cryoarray 20 consists only of a single cryosurface as shown in FIG. 1. It should be noted that since the second-stage cryoarray 20 consists of a single cryosurface, as opposed to multiple veins, the regeneration time is significantly reduced over prior art cryopumps, since there is less mass to heat to vaporize the cryocondensed gases.

The purpose of the first-stage pump 11 is to remove gases, such as water vapor, At, CO, $CO_2$, $N_2$, and $O_2$ from the principal vacuum chamber by cryocondensation. As stated earlier certain other gases, principally $H_2$ He and Ne are not removed since cryopump 11 does not utilize a sorbent material for cryosorption. Therefore, these gas molecules disperse through apertures (not shown in FIG. 1) in gate valve 34 to the getter pump region. However, the bulk of the other gases are removed so that hydrogen is the only active gas remaining after cryopumping. As was stated earlier, the second-stage cryoarray 20 contains no sorbent material for cryosorption of hydrogen. In prior art pumps containing a sorbent material the temperature of the second-stage cryoarray would be nominally 10° K.; however, in this structure a temperature of 20° K. is quite adequate to pump the cryocondensable gases typically present. This feature greatly lengthens the normal operating life expectancy of this cryopump due to the less stringent second-stage temperature requirement. This feature also provides a significant reduction in the regeneration time over prior art cryopumps, since the greatest cool down period occurs between 20° K. and 10° K.

The second-stage pump 14 preferably includes three getter pump elements 31, 32, and 33 shown in FIG. 1. Any number of getter pump elements could be used dependent upon the pumping requirements of the system. (Getter pumps similar to the ones used herein are made by a number of manufacturers, including Sacs Getters S.p.A. of Milan, Italy.) Although a large number of active gases such as CO, $CO_2$, $O_2$, $N_2$, $H_2$, water vapor and hydrocarbons may be pumped by a Better pump, in this application its principal function is to remove only hydrogen molecules that my be present in the vacuum chamber. Indeed it is a feature of this invention that the bulk of the gases be first removed by the upper crypump 11 leaving only $H_2$ as the principal gas remaining. Although helium and neon are not removed by either cryocondensation or getter pumping, these gases are inert, non reactive gases that do not affect the quality of deposition processes. Furthermore, after cryopumping hydrogen represents the principal component of the remaining gas which is ultimately removed by getter pump 14. Therefore, very little inert gas remains in the chamber and unpumped.

Figure 2:
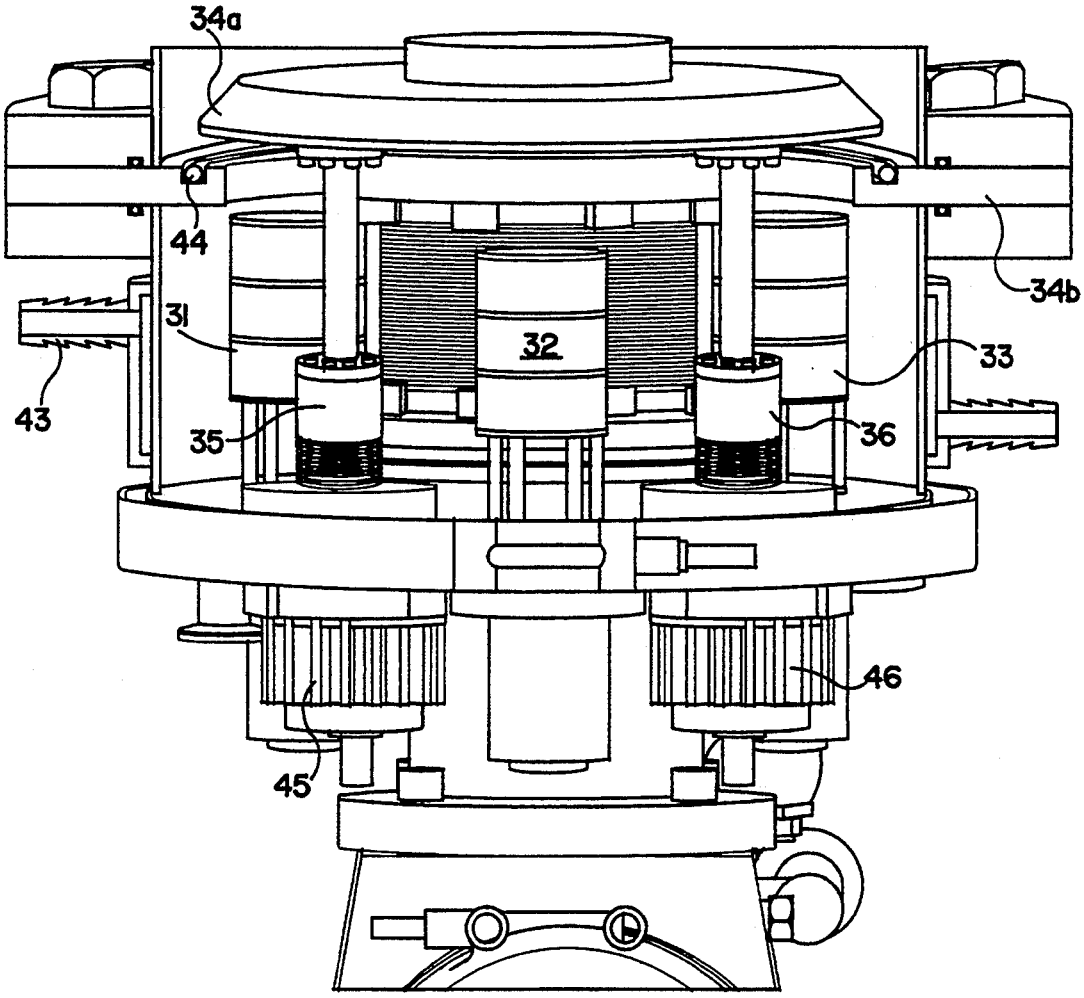
FIG. 2 is a partial cross-sectional diagram representation of the center section of the hybrid vacuum pump in accordance with this invention.

Referring to FIG. 2 separating the first-stage pump from the second-stage pump 14 is a gate valve 34 which when dosed, protects the getter pumps 31, 32 and 33 during regeneration flushing of nitrogen through the first-stage pump 11. Gate valve 34 includes two metal plates 34 a and b which when pressed together seal and isolate cryopump 11 from getter pump 14. The valve is opened and closed by stepper motors 45 and 46 which cause screw actuators 35 and 36 to rotate either up or down. The top (as shown) of actuators 35 and 36 are affixed to plate **34*a* thus causing the plate to move in contact with or move away from fixed plate 34*b*. When the plates are separated, as shown in FIG. 2, gas molecules pass from one pump chamber to the other through an annular opening in plate 34*a*. O-ring 44** vacuum seals the two plates when in a closed position.

Operationally, the vacuum pumping apparatus depicted in FIG. 1 can be used continuously to pump a very high quality vacuum chamber. At the start of a work cycle, a roughing pump connected to an exhaust port (not shown) would be used to reduce the chamber pressure. At the desired pressure, a high vacuum valve, not shown in FIG. 1, would be opened to allow gases still in the vacuum chamber to enter pump 10 through inlet 12. Cryoarrays 18 and 20 pump the principal gases entering the cryopump section 11. The remaining $H_2$ gas molecules disperse through an open gate valve 34 and enter getter pump 14 for removal. During regeneration of the first-stage pump 11 and activation of the second-stage getter pump 14, gate valve 34 should be dosed to protect the getter from the liberated condensed gases that would be sorbed into the getter surface. During activation of the getter, the hydrogen is expelled rather than being diffused into the bulk of the Bettering material. This greatly increases the useful life of the getter pumps.

Alternatively, the vacuum pump 10 system could operate without gate valve 34 if certain steps were taken during regeneration flushing of the cryopump 11. The elimination of gate valve 34 would lessen the cost of the overall pump and operationally create a much larger opening between the two pumps 11 and 14 greatly facilitating the diffusion of hydrogen gas molecules from the cryopump to the getter pumps. However, to protect the getters from possible contamination during regeneration, dry argon should be injected at the start of the regeneration period into inlet port flooding the getters with an inert non reactive gas. The argon and released gases from cryopump 11 are pumped out an exit port adjacent cryopump 11. During regeneration the actual flow of argon needs to be regulated to prevent a back stream of gas from the cryopump 11 to the getter pumps 14. In addition either a water trap or appropriate attitude control should be used to prevent liquefied water or other liquefied gases from dripping off cryosurfaces 18 or 20 onto the getter pumps which would contaminate them.

Figure 3:
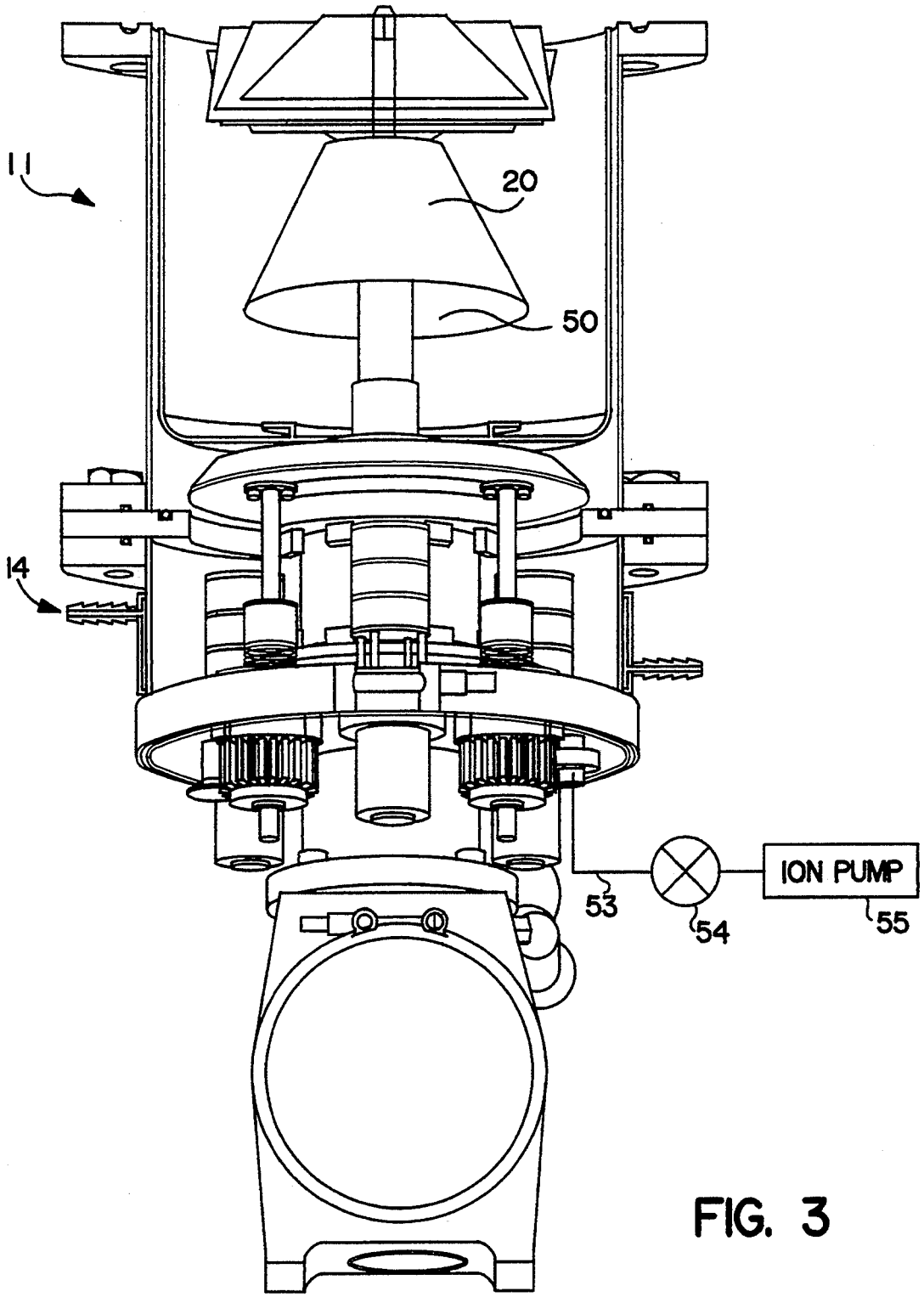
FIG. 3 is another partial a cross-sectional diagram representation of the cryopump chamber depicting a modified structure in accordance with another aspect of the invention.

An improvement of the pump structure previously disclosed is shown in FIG. 3. In addition to the two-pump structure disclosed, a very small amount of activated charcoal 50 has been added to the second-stage cryosurface 20. Instead of using this sorbent material, as in the prior art structures for pumping hydrogen, the purpose here is for pumping the small amount of helium and neon that may be present after the bulk of the other gases, including hydrogen have been removed. To limit or restrict the pumping of hydrogen by the charcoal there are several techniques that may be successfully employed. One such technique is to periodically and partially regenerate cryosurface 20 to drive off any sorbed gases. This is accomplished by isolating the pump from the host vacuum chamber and allowing the second stage cryosurface 20 to be warmed to a temperature (>30° K.) that releases the helium, neon and hydrogen gases. The released hydrogen will immediately be pumped by the getter pump 14. When this is done the temperature of the pump should be reduced to its normal operating temperature. An operating temperature of nominally 10° K. will result in the pumping of the remaining neon and helium by the charcoal. Such a hybrid-pump configuration would have utility where it was important to have the absolute pressure of the vacuum chamber be as low as possible and simply devoid of the reactive gases such as water vapor and hydrogen. The disadvantages to the addition of the charcoal 50 are very slight. As the quantities of neon and helium that potentially could be pumped are very small, the amount of charcoal needed is accordingly very small. For most applications a surface area of 1 or 2 $cm^2$ would be sufficient to accomplish the needed pumping, Such a small amount of charcoal would have an exceedingly small impact on the potential flaking problem mentioned above.

An alternative to the partial regeneration technique just described is to regulate the temperature of cryosurface 20. This could be done by reducing the cooling effect of the refrigerator which will cause the temperature of cryosurface 20 to be elevated and thus prevent the charcoal from cryotrapping Another improvement of the pump structure previously disclosed above is also shown in FIG. 3. In addition to the two-pump structure 11 and 14 disclosed, an ion pump 55 has been added to perform essentially the same function as the charcoal, that is to reduce the partial pressure of helium and neon. Preferable the ion pump 55 would be employed in place of the charcoal sorbent material 50 rather than in combination- Operationally, the ion pump 55 is directly connected to the getter pump chamber 14 through a conduit 53 and a gate valve 54. The gate valve 54 would be dosed during periods of regeneration or activation of the two-pump structure 11 and 14. This prevents ion pump 55 from pumping those gases released during regeneration or activation. Ion pumps used for this application are well known and made by a number of manufactures, e.g, Model 921-0015, manufactured and sold by Varian Vacuum Products Incorporated, Lexington, Mass.

While there has been shown and described above a particular arrangement for a cryopump structure having an improved means of removing hydrogen from the vacuum chamber, for the purpose of enabling a person of ordinary skill in the art to make and use the invention, it will be appreciated that the invention is not limited thereto. Accordingly, any modifications, variations, or equivalent arrangements within the scope of the attached claims should be considered to be within the scope of the invention.

What is claimed is:

1. Apparatus for vacuum pumping an enclosed chamber to remove hydrogen and other gases from the chamber, said apparatus comprising:

a first pumping device in fluid communication with said enclosed chamber, said first pumping device having cryosurfaces mounted therein for cryocondensation and cryotrapping of the principal gases present in said enclosed chamber, said cryosurfaces being free of any sorbent material;

a second pumping device in fluid communication with said first pumping device and including at least one getter pump for removing by chemical sorption the active gases not removed from said enclosed chamber by said first pumping device; and, a unitary housing enclosing in a single body said first pumping stage and said second pumping stage.

2. Apparatus for pumping an enclosed chamber as defined in claim 1 in which said housing includes:

an auxiliary entry port located adjacent to said second pumping device for use in injecting an inert gas into said second pumping device during periods of regeneration and activation of said first and second pumping devices respectively; and an auxiliary exit port located adjacent to said first pumping device for use in combination with said entry port in exhausting said inert gas and any previously cryopumped and sorbed gases from said pumping apparatus.

3. Apparatus for pumping an enclosed chamber as defined in claim 2 further comprising.

means for interrupting said fluid communication between said first pumping device and said second pumping device to isolate said second pumping device during periods of regeneration of said first pumping device.

4. Apparatus for pumping an enclosed chamber as defined in claim 3 wherein said second pumping device includes a plurality of getter pumps.

5. Apparatus for pumping an enclosed chamber as defined in claim 4 wherein said cryosurfaces further comprises:

a cryoarray mounted within said first pumping device for pumping by cryocondensation and cryotrapping gases within said enclosed chamber, and a single cryosurface mounted within said first pumping device in close proximity to said cryoarray and having a pumping temperature >17° K., but less than the pumping temperature of said cryoarray.

6. Apparatus for pumping an enclosed chamber for removing gases including hydrogen, helium and neon from the chamber, said apparatus comprising:

a first pumping device in fluid communication with said enclosed chamber, said first pumping device having first and second cryosurfaces mounted therein for cryocondensation and cryotrapping of the principal gases present in said enclosed chamber, said second cryosurface having at most a small quantity of cryosorption material of less than about 10 $cm^2$ in area;

a second pumping device in fluid communication with said first pumping device and including at least one getter pump for removing by chemical sorption the active gases not removed from said enclosed chamber by said first pumping device;

a unitary pump housing enclosing said first and said second pumping devices; and means for controlling the temperature of said second cryosurface to prevent the cryosorption of gases from said enclosed chamber allowing said second pumping device to pump the bulk of hydrogen gas from said enclosed chamber.

7. Apparatus for cryopumping an enclosed chamber as defined in claim 6 further comprising;

means for interrupting said fluid communication between said first pumping device and said second pumping device for isolating said second pumping device during periods of regeneration of said first pumping device,

8. Apparatus for pumping an enclosed chamber as defined in claim 7 wherein said second pumping device includes a plurality of getter pumps.

9. Apparatus for pumping an enclosed chamber as defined in claim 8 wherein said cryosorption material includes activated charcoal.

10. A hybrid vacuum pumping device for pumping an enclosed chamber, said pumping device comprising;

a cryogenic pumping device in fluid communication with said enclosed chamber and having cryoarrays mounted therein for cryocondensation and cryotrapping of the principal gases present in said enclosed chamber, said cryoarrays being free of any sorbent material;

a getter pump in fluid communication with said first-stage pump for pumping principally hydrogen from said enclosed chamber, said getter pump and said cryogenic pumping device being enclosed with an integral housing; and an auxiliary pumping device in fluid communication with said getter pump and said cryogenic pumping device, for removing from said chamber any inactive gases not removed by said cryogenic pumping device and said getter pump.

11. A hybrid vacuum pumping device for pumping an enclosed chamber as defined in claim 10 wherein said auxiliary pumping device comprises an ion pump.

12. A hybrid vacuum pumping device for pumping an enclosed chamber as defined in claim 11 further comprising a gate valve for interrupting said fluid communication between said getter pump and said cryogenic pumping device.

13. A hybrid vacuum pumping device for pumping an enclosed chamber as defined in claim 12 further comprising:

means for interrupting said fluid communication between said cryogenic pumping device and said getter pump for isolating said getter pump during periods of regeneration of said cryogenic pumping device.

14. A hybrid vacuum pumping device for pumping an enclosed chamber as defined in claim 13 wherein said getter pump includes a plurality of getter pumps.

15. A method of vacuum pumping an enclosed chamber, comprising the steps of:

cryogenically pumping the gases in said chamber to a pressure between $10^{-6}$ and $10^{-9}$ Torr using cryocondensation and cryotrapping processes using a cryogenic pump free of sorbent materials; and at a pressure between $10^{-6}$ and $10^{-9}$ Torr opening a closed path to a getter pump and pumping any remaining active gases including hydrogen within said chamber using a getter pump.

16. A method of vacuum pumping as defined in claim 15 further comprising the step of: pumping helium and neon from said chamber with an auxiliary pumping device.

17. A method of vacuum pumping as defined in claim 16 wherein the step of pumping helium and neon from said chamber includes pumping helium and neon with an ion pump.

* * * * *